US007455537B2

(12) United States Patent
Steinhardt et al.

(10) Patent No.: US 7,455,537 B2
(45) Date of Patent: Nov. 25, 2008

(54) SPARK PLUG BOOT

(75) Inventors: Dennis Steinhardt, West Bend, WI (US); Kevin Krahl, Delafield, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 65 days.

(21) Appl. No.: 11/800,375

(22) Filed: May 4, 2007

(65) Prior Publication Data

US 2007/0293064 A1 Dec. 20, 2007

Related U.S. Application Data

(60) Provisional application No. 60/814,660, filed on Jun. 16, 2006.

(51) Int. Cl.
*H01R 13/62* (2006.01)

(52) U.S. Cl. ..... 439/125; 439/620.21; 123/169 P; 123/169 PA; 123/169 PH; 123/605

(58) Field of Classification Search ..... 439/125–128, 439/620.21, 620.01; 123/169 P, 169 PA, 123/169 PH, 605
See application file for complete search history.

(56) References Cited

U.S. PATENT DOCUMENTS

| | | | |
|---|---|---|---|
| 1,976,901 | A | 10/1934 | Steenweg |
| 1,991,574 | A | 2/1935 | Rabezzana |
| 2,109,030 | A | 2/1938 | Nowosielski |
| 2,145,629 | A | 1/1939 | Nicoud et al. |
| 2,353,199 | A | 7/1944 | Stoffel et al. |
| 2,353,322 | A | 7/1944 | Stoffel et al. |
| 2,359,436 | A | 10/1944 | Mascuch |
| 2,366,757 | A | 1/1945 | Stoffel |
| 2,369,186 | A | 2/1945 | Stoffel |
| 2,389,466 | A | 11/1945 | Stoffel |
| 2,399,402 | A | 4/1946 | Spengler |
| 2,409,732 | A | 10/1946 | Browne et al. |
| 3,002,126 | A | 9/1961 | Noir |
| 3,128,139 | A | 4/1964 | Estes |
| 3,191,133 | A | 6/1965 | Texsier |
| 3,212,044 | A | 10/1965 | Cloud, Jr. |

(Continued)

FOREIGN PATENT DOCUMENTS

| | | |
|---|---|---|
| EP | 0 488 216 | 6/1992 |

(Continued)

OTHER PUBLICATIONS

Ruiansanxing Automobile and Motorcyclefittings Co. Ltd., website, http://www.china-sx.com/product5.htm, May 11, 2005, 1 page.

(Continued)

*Primary Examiner*—Gary F. Paumen
(74) *Attorney, Agent, or Firm*—Michael Best & Friedrich LLP

(57) ABSTRACT

A spark plug boot having a resistive element for reducing levels of EMI. The spark plug boot generally includes a spark plug receiving end, a resistive element portion, an ignition wire connecting end, and a conductive metal shell. The spark plug boot may also include one or more elbows, which changes the positional relationship between the spark plug receiving end and the ignition wire connecting end.

13 Claims, 10 Drawing Sheets

U.S. PATENT DOCUMENTS

| | | | | |
|---|---|---|---|---|
| 3,315,206 | A | 4/1967 | Dressel | |
| 3,529,273 | A | 9/1970 | Morris | |
| 3,553,344 | A | 1/1971 | Capehart | |
| 3,680,029 | A | 7/1972 | Berry | |
| 3,686,607 | A | 8/1972 | Berry | |
| 3,697,796 | A | 10/1972 | Livingston | |
| 3,771,006 | A | 11/1973 | Berry | |
| 3,801,950 | A | 4/1974 | Wise | |
| 3,881,051 | A | 4/1975 | Berry | |
| 3,882,341 | A | 5/1975 | Green | |
| 3,883,776 | A | 5/1975 | Berry | |
| 3,915,721 | A | 10/1975 | Kamigaito et al. | |
| 3,915,899 | A | 10/1975 | Kamigaito et al. | |
| 3,919,123 | A | 11/1975 | Kamigaito et al. | |
| 3,923,698 | A | 12/1975 | Kamigaito et al. | |
| 3,965,879 | A | 6/1976 | Fitzner | |
| 3,967,230 | A | 6/1976 | Kamigaito et al. | |
| 4,004,183 | A | 1/1977 | Oki et al. | |
| 4,078,534 | A | 3/1978 | Mayer | |
| 4,145,106 | A | 3/1979 | Livingston | |
| 4,150,865 | A | 4/1979 | Iliff | |
| 4,159,441 | A | 6/1979 | Livingston | |
| 4,186,712 | A | 2/1980 | Fitzner et al. | |
| 4,224,554 | A | 9/1980 | Nishio et al. | |
| 4,274,695 | A | 6/1981 | Fukumori et al. | |
| 4,456,900 | A | 6/1984 | Toyoshima et al. | |
| 4,514,712 | A | 4/1985 | McDougal | |
| 5,091,604 | A | 2/1992 | Kirma | |
| 5,105,054 | A | 4/1992 | Kirma | |
| 5,163,838 | A | 11/1992 | Tura, Jr. et al. | |
| 5,291,872 | A * | 3/1994 | Ghaem | 123/620 |
| 5,603,306 | A | 2/1997 | Tai | |
| 5,975,926 | A | 11/1999 | Uchiyama et al. | |
| 6,360,706 | B1 | 3/2002 | Skinner et al. | |
| 6,374,816 | B1 * | 4/2002 | Funk et al. | 123/605 |
| 6,386,893 | B2 | 5/2002 | Reum et al. | |
| 6,427,673 | B2 | 8/2002 | Morganti et al. | |
| 6,463,918 | B1 | 10/2002 | Moga et al. | |
| 6,615,810 | B2 * | 9/2003 | Funk et al. | 123/605 |
| 6,724,289 | B2 | 4/2004 | Moga et al. | |
| 6,793,863 | B1 * | 9/2004 | Himes et al. | 264/262 |
| 7,252,078 | B2 * | 8/2007 | Kraus et al. | 123/633 |
| 2001/0032636 | A1 | 10/2001 | Morganti et al. | |
| 2003/0034865 | A1 | 2/2003 | Moga et al. | |
| 2005/0045133 | A1 | 3/2005 | Matsuda | |

FOREIGN PATENT DOCUMENTS

| | | |
|---|---|---|
| ES | 1032741 | 6/1996 |
| GB | 1 011 181 | 11/1965 |
| GB | 2 200 258 | 7/1988 |
| JP | 357193775 | 11/1982 |
| JP | 2001 244041 | 9/2001 |

OTHER PUBLICATIONS

Autozone, Book Kit Spark Plugs, website, http://autozone.com/servlet/UiBroker/?UseCase=C003&UserAction=answerQuestion&Par, Dec. 2, 2005, 5 pages.

* cited by examiner

SPARK PLUG BOOT

This application claims priority under 35 U.S.C. sec. 119 to provisional patent application no. 60/814,660, filed on Jun. 16, 2006, which is hereby fully incorporated by reference.

BACKGROUND

The present invention relates to ignition wire connectors for spark plugs. More specifically, the present invention relates to ignition wire connectors that include a resistive and/or an inductive element.

Ignition wire connectors for spark plugs, commonly referred to as "spark plug boots," can be used to physically and electrically connect an ignition wire of an engine to a connector of the spark plug. Spark plug boots generally include a portion that receives, and is coupled to, the connector of the spark plug and a portion that is coupled to the ignition wire. In some instances, the ignition wire is directly connected to the portion of the spark plug boot that is coupled to the connector of the spark plug. In other instances, spark plug boots may include an integrated bend or elbow, which can change the orientation of the ignition wire to the spark plug.

SUMMARY

In one embodiment, the invention provides a spark plug boot having a resistive element for reducing levels of electromagnetic interference or EMI. The spark plug boot generally includes a spark plug receiving end, a resistive element portion, and an ignition wire connecting end. The spark plug receiving end is connected to a spark plug, while the ignition wire connecting end is connected to an ignition wire (or, for example, an ignition wire connector). The spark plug boot may also include one or more elbows, which may change the orientation of the spark plug receiving end and/or the ignition wire connecting end with respect to the spark plug and/or ignition wire.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
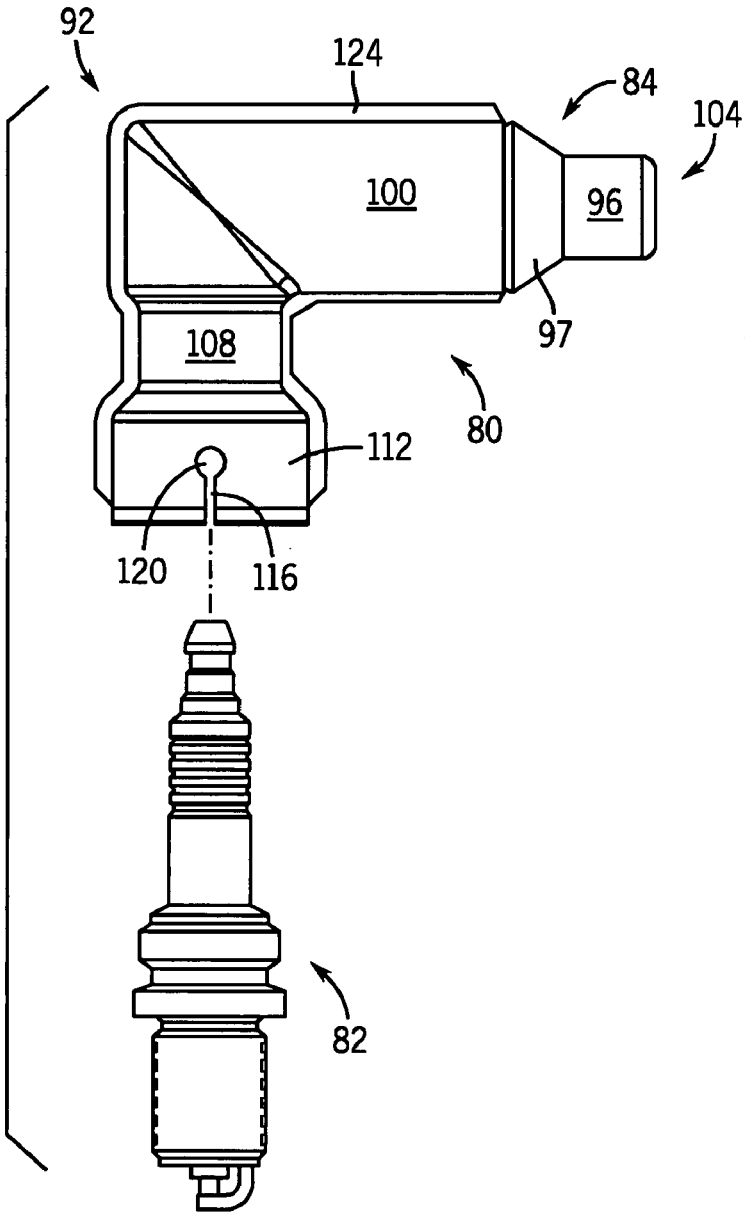
FIG. 1 is a side view of an embodiment of a spark plug boot.
Figure 2:
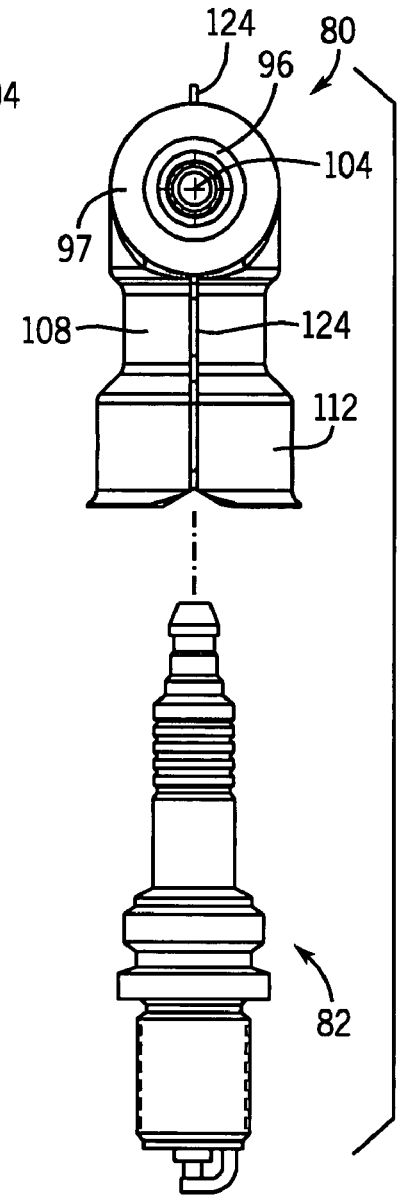
FIG. 2 is an end view of the spark plug boot shown in FIG. 1.

FIGS. 1 and 2 illustrate an embodiment of a spark plug boot 80 that is connectable to a spark plug 82. The spark plug boot 80 includes an ignition wire end ("wire end") 84 and a spark plug receiving end ("plug end") 88. Additionally, the spark plug boot 80 includes an elbow 92 that is positioned between the wire end 84 and the plug end 88. The elbow 92 provides an approximate 90 degree turn in the path between the wire end 84 and the plug end 88. In other embodiments, the elbow 92 may be configured having a sharper or more obtuse angle than 90 degrees.

Figure 3:
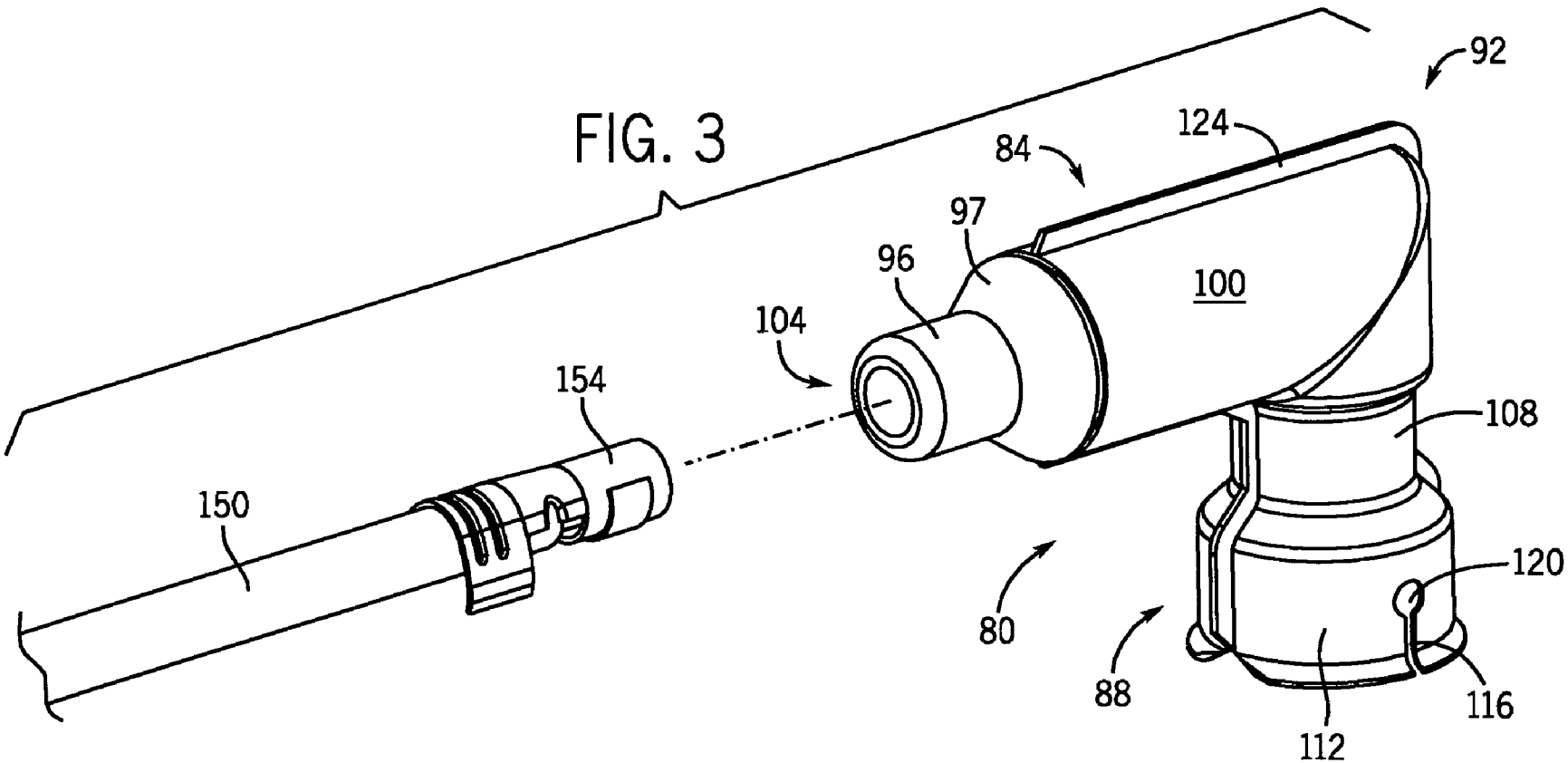
FIG. 3 is a perspective view of the spark plug boot shown in FIGS. 1-2.

The wire end 84 of the spark plug boot 80 generally includes a wire receiving portion 96 and a resistive element portion 100. The wire receiving portion 96 includes a wire opening 104 that is sized to allow an ignition wire (as shown in FIG. 3) to be inserted. Opposite the wire opening 104, the wire receiving portion 96 widens into a bell shaped portion 97. In some embodiments, the wire receiving portion 96 is a portion of a larger silicone rubber layer that encases the entire contents of the spark plug boot 80, as described with respect to FIG. 5. The rubberized material provides a weather resistant covering for the ignition wire. In other embodiments, the wire receiving portion 96 may be composed of another relatively flexible plastic or rubber material.

Figure 4:
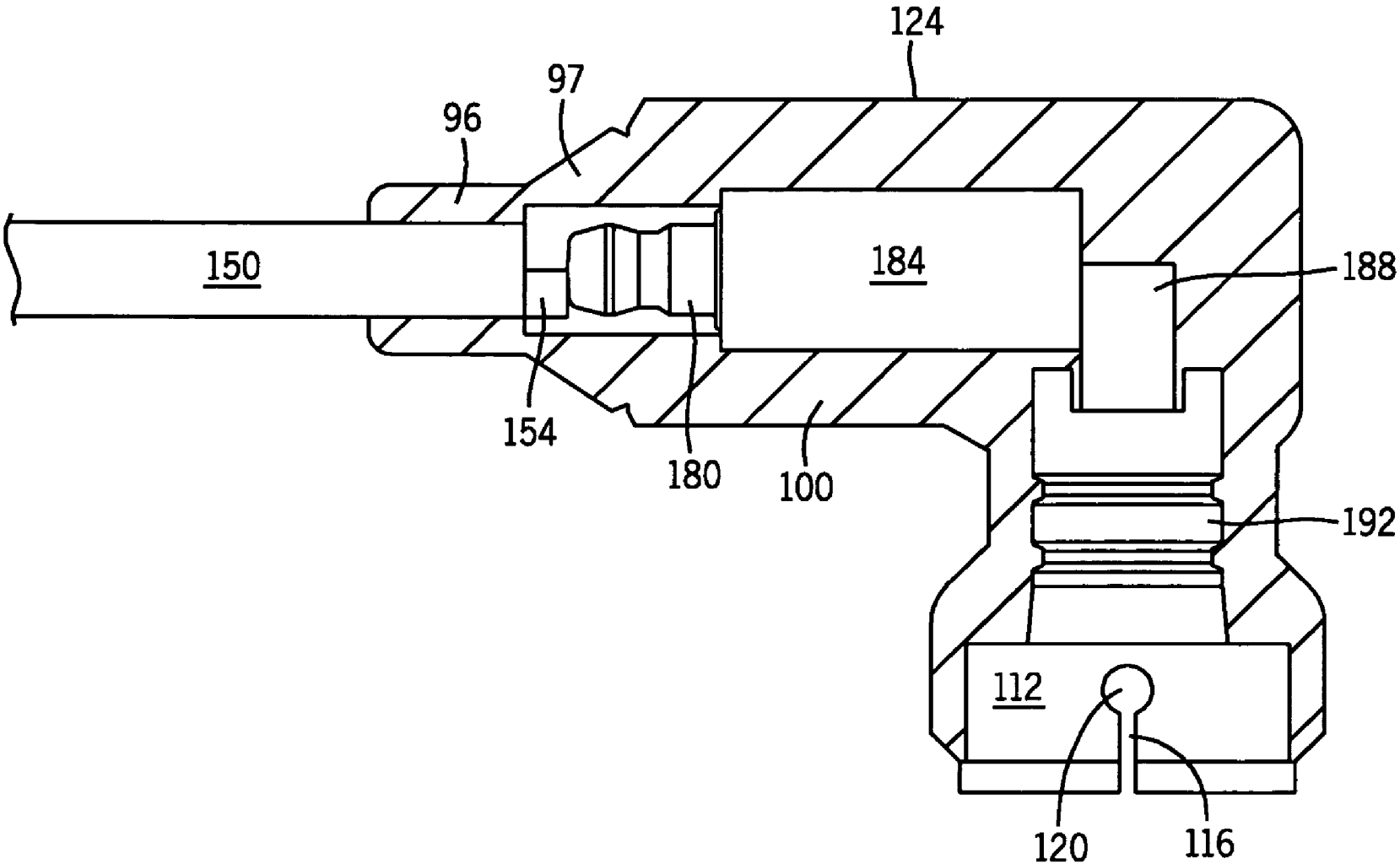
FIG. 4 is a cross-sectional view of the spark plug boot shown in FIGS. 1-3.

The resistive element portion 100 may, in some embodiments, house an ignition wire connector and a resistive element, as described in greater detail with respect to FIG. 4. As such, the resistive element portion 100 may be sized and configured according to the configuration of the ignition wire and/or the configuration of the resistive element.

The plug end 88 of the spark plug boot 80 includes a spark plug coupling portion 108 that widens into a receptacle housing 112. The receptacle housing 112 of the spark plug boot 80 is described in greater detail with respect to FIG. 4. Briefly, the receptacle housing 112 includes a pair of slots 116 and openings 120 (see FIG. 3) that are positioned opposite each other. The slots 116 and openings 120 may create a more secure coupling relationship between the spark plug boot 80 and the spark plug 82.

Referring still to FIGS. 3 and 4, the plug end 88 and the resistive element portion 100 of the wire end 84 are enclosed in a stamped steel casing having a lip 124. The stamped steel casing grounds the spark plug boot 80 to the spark plug (when coupled), and conducts EMI to ground. Additionally, the stamped steel casing provides a relatively robust shell for the components housed within the spark plug boot 80. In other embodiments, the spark plug boot 80 may be covered by an alternative electrically conductive material.

FIG. 3 is a perspective view of the spark plug boot 80 shown in FIGS. 1 and 2. As shown in FIG. 3, an ignition wire 150 having an ignition wire connector 154 may be inserted into the wire opening 104 of the wire receiving portion 96. In other embodiments, the ignition wire 104 may be fitted with an alternative ignition wire connector 154. For example, in one embodiment, the ignition wire connector is an elbow-type ignition wire connector that is designed to receive the connector of a spark plug with a snap-fit (see FIGS. 6-11). As such, the configuration of the wire receiving portion 96 may depend on the configuration of the ignition wire connector 154.

FIG. 4 is a cross-sectional view of the spark plug boot 80 shown in FIGS. 1-3. As shown in FIG. 4, the interior space of the spark plug boot 80 generally includes a male-type ignition wire connector 180, a resistive element 184, an intermediate terminal 188, and a spark plug receptacle 192. In other embodiments, the interior of the spark plug boot 80 may contain fewer or more components than those shown in FIG. 4. For example, as described with respect to FIG. 5, the interior space of the spark plug boot 80 may include a rubber material. Additionally or alternatively, in some embodiments, the intermediate terminal 188 shown in FIG. 4 may be omitted, and the resistive element 184 may interface directly with the male-type ignition wire connector 180 and the spark plug receptacle 192.

In some embodiments, the male-type ignition wire connector 180 is shaped similarly to a connector of a conventional spark plug (see FIGS. 1 and 2), and receives a conventional type female-type ignition wire connector 154 (see also FIG. 3) with a snap-fit. As such, an electrical connection is made between the male-type ignition wire connector 180 and the female-type ignition wire connector 154 when the ignition wire 150 is inserted into the ignition wire opening 104 of the ignition wire receiving portion 96. In other embodiments, the element connecting the ignition wire 150 to the resistive element 184 may be configured differently, and may depend on the configuration of the ignition wire connector 154.

The resistive element 184 is electrically connected to the male-type ignition wire connector 180. In the embodiment shown in FIG. 4, the resistive element 184 is electrically connected to the male-type ignition wire connector 180 with a direct end-to-end connection (e.g., an abutting connection with no wires). In other embodiments, the resistive element 184 may be at least partially received male-type ignition wire connector 180 with a male/female-type connection, or vice versa. The resistive element 184 can be used to reduce the overall electromagnetic interference ("EMI") emitted from the spark plug 82 (shown in FIGS. 1 and 2). For example, by introducing the resistive element 184 between an ignition wire and a spark plug, some of the EMI that would normally be inherent in a direct connection between the ignition wire and the spark plug may be eliminated. In the embodiment shown in FIG. 4, the resistive element 184 is a wire wrapped resistor having a ceramic body. In other embodiments, however, the resistive element 184 may be a wire wrapped resistor or other resistive and/or inductive component.

The intermediate terminal 188 is electrically connected to the resistive element 184. As shown in FIG. 4, the intermediate terminal 188 contacts the resistive element 184 directly, and no wires are required between the two components. The intermediate terminal 188, in some embodiments, is used only to electrically connect the resistive element 184 to the spark plug receptacle 192. In other embodiments, the intermediate terminal 188 may be replaced by another element (e.g., an additional resistive element) or omitted from the spark plug boot 80 entirely.

The spark plug receptacle 192 is electrically connected to the intermediate terminal 188, and is generally shaped to receive a connector of a spark plug (see FIGS. 1 and 2). In some embodiments, the spark plug receptacle 192 is shaped such that the spark plug connector is received with a snap and/or form-fit. Additionally, the spark plug receptacle 192 may be configured having alternative lengths, allowing alternative amounts of the spark plug connector and insulator to be inserted to the spark plug receptacle 192.

Figure 5:
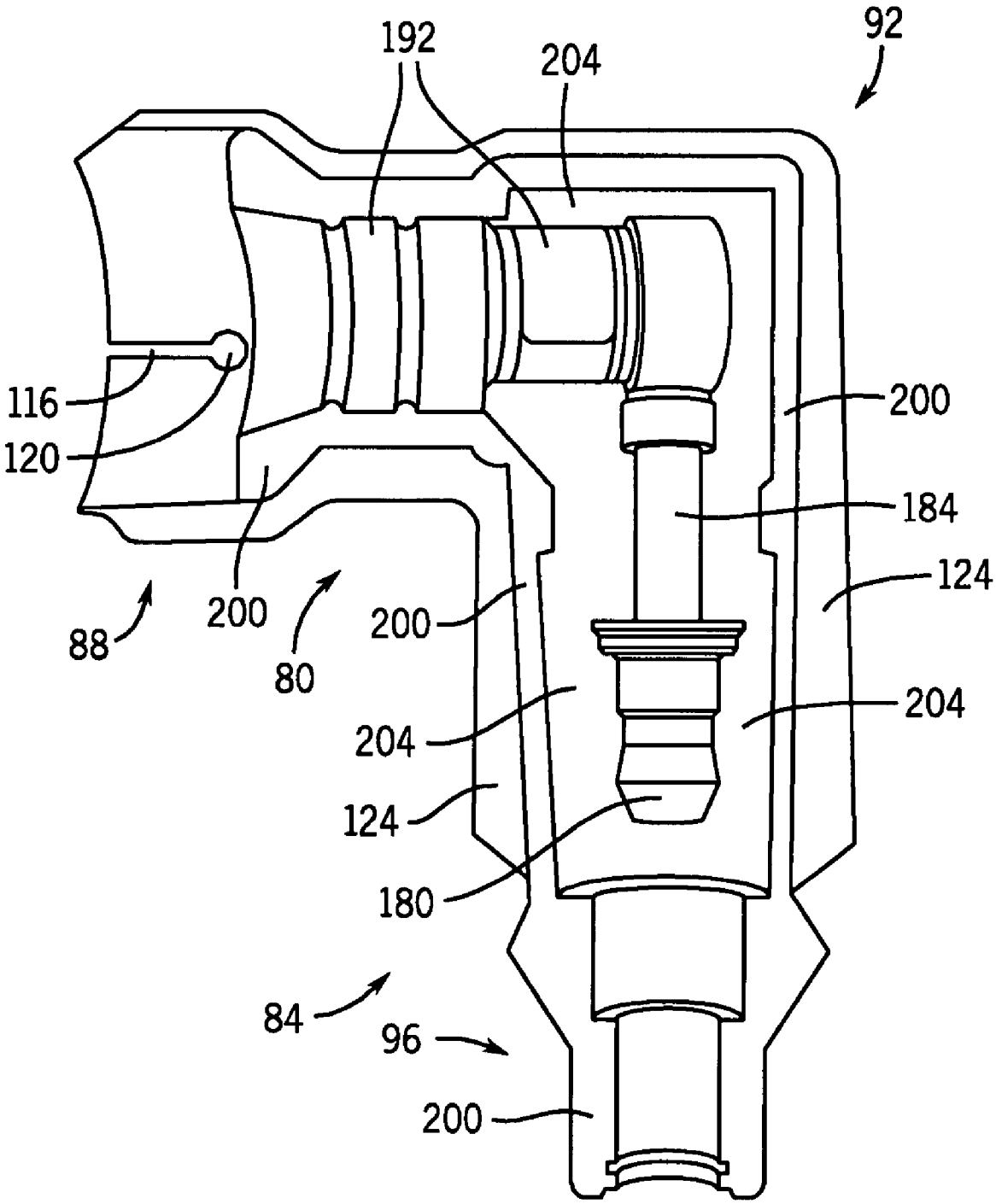
FIG. 5 is a photograph of the spark plug boot shown in FIGS. 1-4.

FIG. 5 is a photograph of the sectioned spark plug boot 80. As previously shown, the spark plug boot 80 generally includes the wire end 84, the plug end 88, and the elbow 92 that is positioned between the wire end 84 and the plug end 88. Additionally, in the embodiment shown in FIG. 5, the spark plug boot 80 includes the steel casing 124, a rubber layer 200, and a polybutylene terephthalate ("PBT") layer or casing 204, which surround the spark plug receptacle 192, the resistive element 184, and the male-type ignition wire connector 180.

Figure 8:
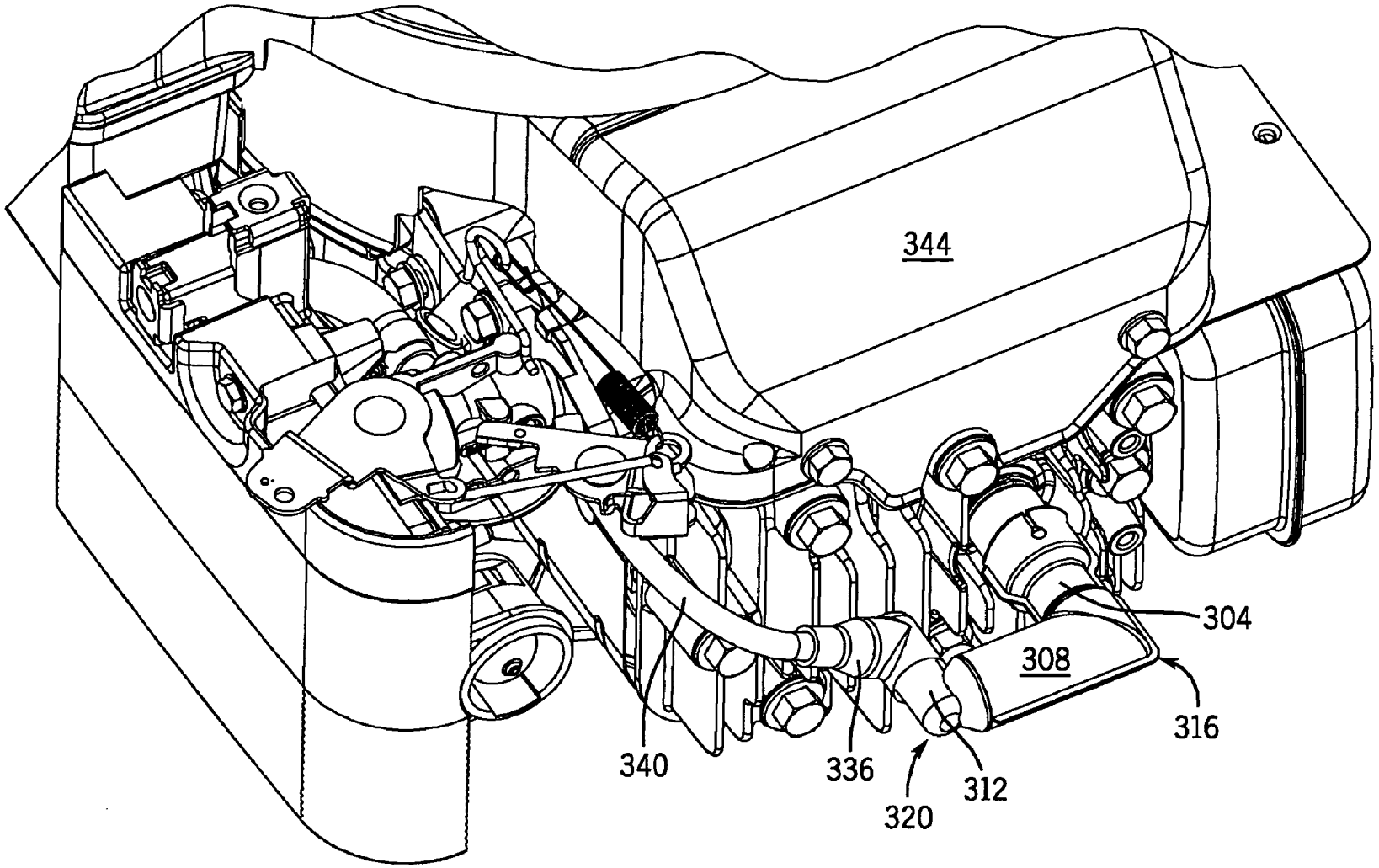
FIG. 8 is a perspective view of the spark plug boot shown in FIGS. 6 and 7 coupled to an engine.
Figure 11:
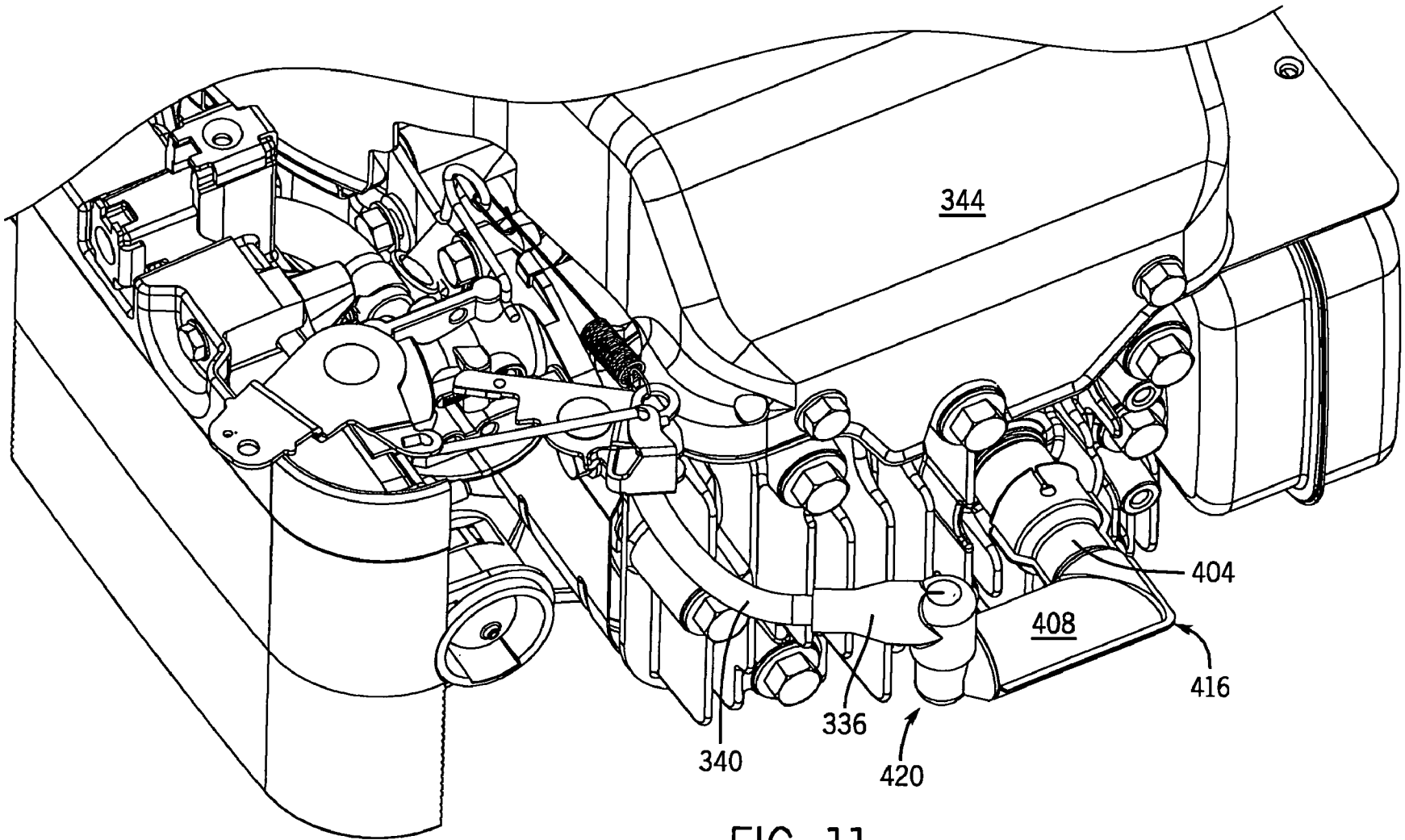
FIG. 11 is a perspective view of the spark plug boot shown in FIGS. 9 and 10 coupled to an engine.

The steel casing 124 provides a rigid case for the components contained within the spark plug boot 80. On the plug end 88, the steel casing includes the integrated plug connector portion having the slot 116 and the opening 120 that may be coupled to a spark plug and/or engine (as shown in FIGS. 8 and 11) with a snap-fit. As previously described, the steel casing 124 also provides a ground path for EMI when the spark plug boot 80 is coupled to a spark plug. Additionally, the steel casing 124 may shield the environment surrounding the spark plug boot 80 from stray EMI.

The rubber layer 200, in the embodiment shown, extends from the wire end 84 to the plug end 88 and surrounds the entire contents of the spark plug boot 80. Additionally, the rubber layer 200 includes the wire receiving portion 96, which protrudes from one end of the steel casing 124. The rubber layer 200 is generally comprised of a silicone substance having a high temperature threshold, but can be comprised of any such suitable material. The rubber layer 200 may provide an electrically non-conductive casing (e.g., an insulator) around the electrically conductive components (i.e., the spark plug receptacle 192, the resistive element 184, and the ignition wire connector 180) within the spark plug boot 80, which may reduce the potential of an electrical shock to a user. Additionally, the rubber layer 200 helps to keep moisture and other foreign material from entering the interior space of the spark plug boot 80, while insulating the electrically conductive components from relatively high heat (e.g., approximately 300 degrees Fahrenheit) of the engine (see FIGS. 8 and 11).

The PBT layer 204 provides a non-conductive capsule for the electrically conductive components of the spark plug boot, which also helps to thermally insulate the electrically conductive components from the potentially high heat generating components external to the spark plug boot 80 (e.g., an engine). In an embodiment, the PBT material is preferably 20 percent glass-filled. In other embodiments, a different type of protective, heat resistant material may be used.

The spark plug receptacle 192, the resistive element 184, and the male-type ignition wire connector 180 provide an electrically conductive path between a spark plug coupled to the plug end 88 and an ignition wire that is coupled to the wire end 84. In some embodiments, the spark plug receptacle 192, the resistive element 184, and the ignition wire connector 180 all make a direct electrical connection with the component adjacent to it (e.g., no wires are required to connect the components). These direct connections may be simple abutting connections or may have a female/male-type relationship (e.g., one component is at least partially received by the other component).

The resistive element 184 is preferably a wire wound resistor having a ceramic body. The resistive element 184, as previously described, may help to reduce the amount of EMI that is emitted from the area near the spark plug.

Figure 6:
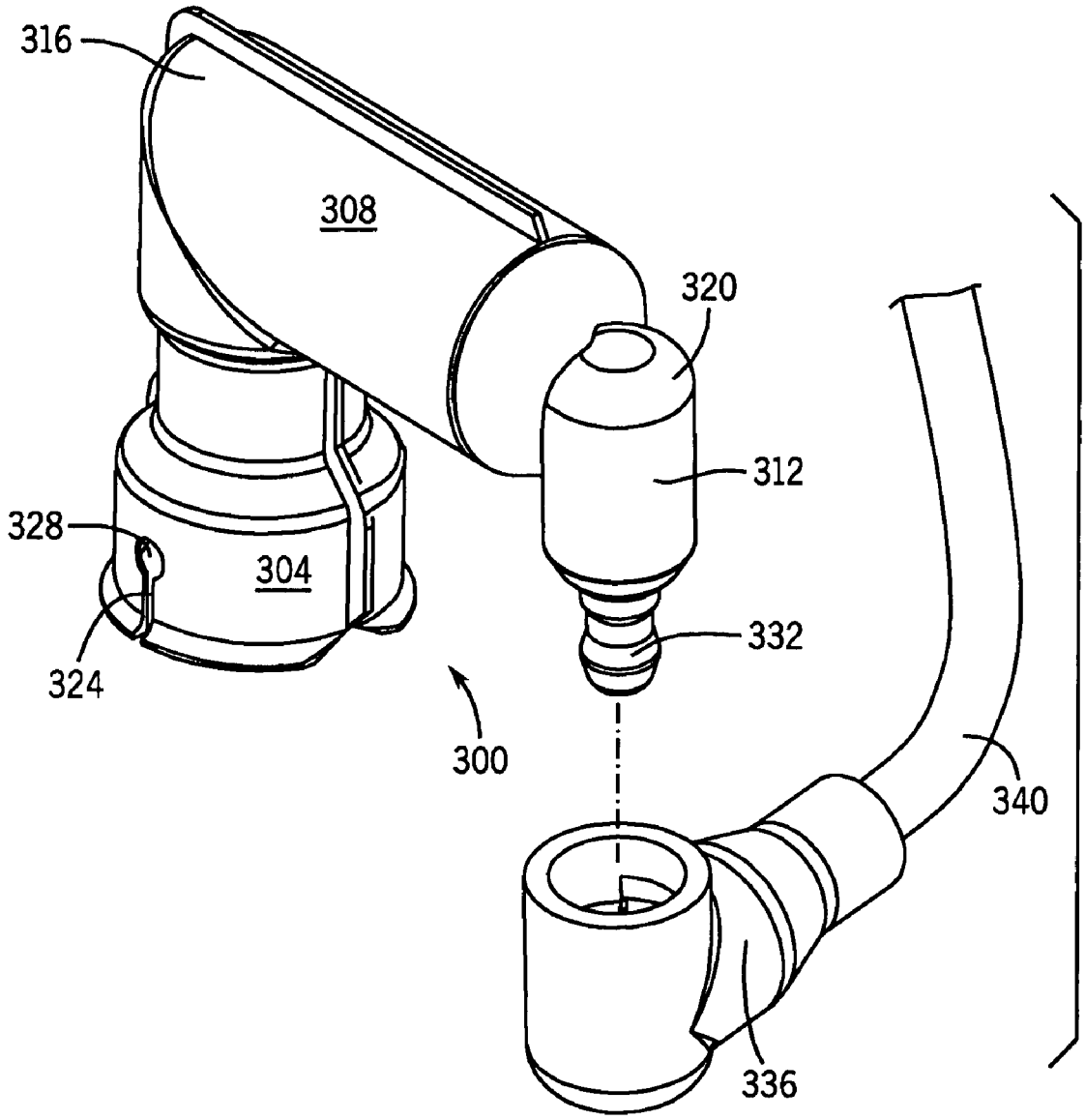
FIG. 6 is a perspective view of an embodiment of a spark plug boot having two elbows.

FIG. 6 is a perspective view of an exemplary embodiment of a spark plug boot 300 having a spark plug receiving end ("plug end") 304, a resistive element portion 308, and an ignition wire connecting end ("wire end") 312. Additionally, a first elbow 316 is positioned between the plug end 304 and the resistive element portion 308, while a second elbow 320 is positioned between the resistive element portion 308 and the wire end 312. In the embodiment shown in FIG. 8, the first and second elbows 316 and 320 are approximately 90 degrees each, and all of the sections of the spark plug boot 300 (i.e., the plug end 304, the resistive element portion 308, and the wire end 312) lie in the same plane. Such an arrangement creates a generally U-shaped spark plug boot 300, with the plug end 304 and the wire end 312 pointed in approximately the same direction. This arrangement (with all sections in the same plane) may also allow for a relatively easy molding and production process. However, in other embodiments, the first and second elbows 316 and 320 may be angled more or less than the 90 degrees shown. Additionally, as described with respect to FIGS. 9-11 below, the first and second elbows 316 and 320 may be oriented differently with respect to one another, so that at least two of the sections of the spark plug boot 300 are positioned in different planes.

Referring still to FIG. 6, the plug end 304 includes a slot 324 and an opening 328 (similar to the embodiment shown in FIGS. 1-5), which may aid in the coupling of the plug end 304 to a spark plug. The resistive element portion 308 houses a resistive element, which may be similar to the resistant element 184 shown in FIG. 5. For example, in some embodiments, the resistive element is a wire wound resistor having a ceramic body that is electrically connected to both the plug end 304 and the wire end 312. The wire end 312 includes a male-type ignition wire connector 332. The male-type ignition wire connector 332 is connectable to a female-type ignition wire connector 336 of an ignition wire 340.

Figure 7:
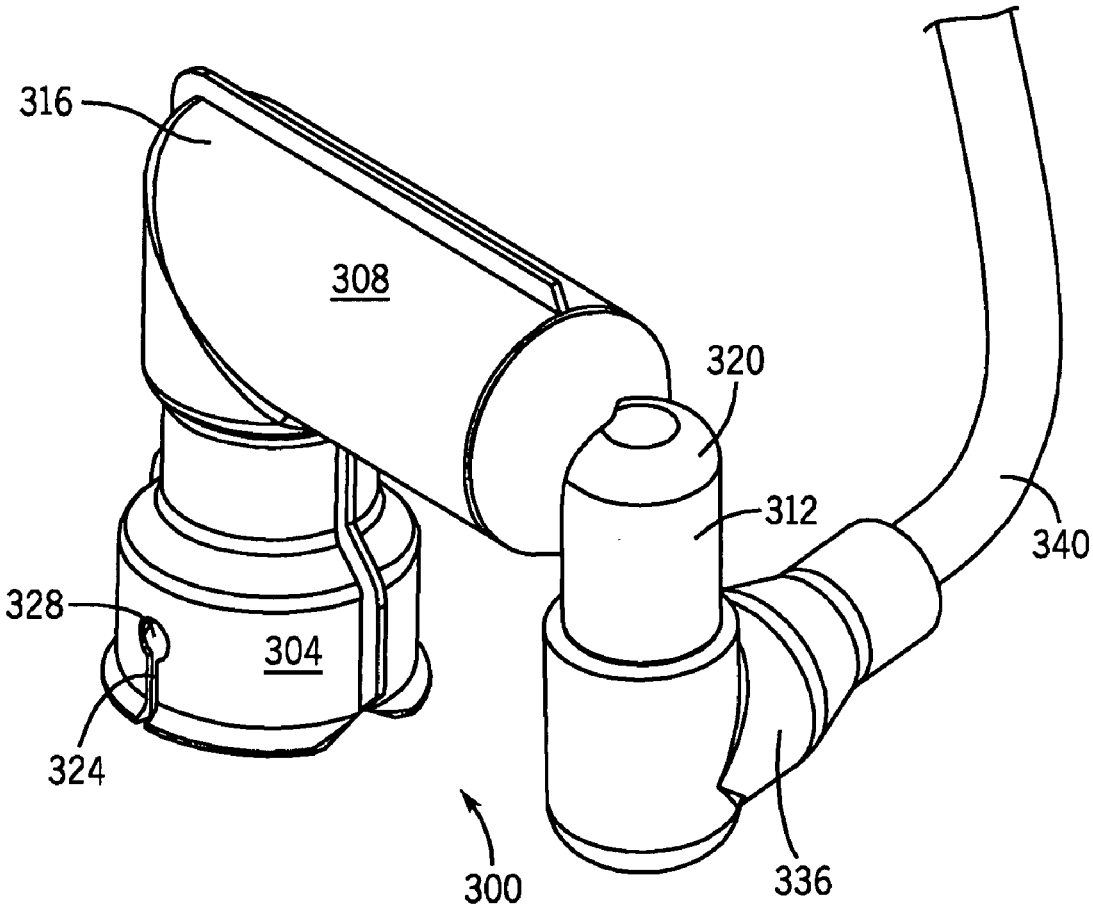
FIG. 7 is another perspective view of the spark plug boot shown in FIG. 6.

FIG. 7 is a perspective view of the spark plug boot 300 shown in FIG. 6 having the female-type ignition wire connector 336 of the ignition wire 340 connected to the male-type ignition wire connector 332 of the wire end 312. As shown in FIG. 7, the female-type ignition wire connector 336 fits over the top of the male-type ignition wire connector 332. As a result, the female-type ignition wire connector 336 does not protrude past the relative end of the plug end 304. Additionally, such an arrangement may prevent the female-type ignition wire connector 336 and the ignition wire 340 from extending away from the spark plug boot 300 when the spark plug boot 300 is coupled to an engine.

FIG. 8 illustrates the spark plug boot 300 shown in FIGS. 6 and 7 coupled to an engine 344. As shown in FIG. 8, the plug end 304 is coupled to a spark plug that is threaded into the engine 344. Additionally, the wire end 312 is connected to the female-type ignition wire connector 336 of the ignition wire 340. Due to the general U-shape of the spark plug boot 300, the wire end 312 is pointed back toward the engine 344, and in the same direction as the plug end 304. As a result, the connected female-type ignition wire connector 336 is directed back toward the engine 344, rather than out and away from the engine 344. Such an arrangement may help to reduce the amount that the ignition wire 340 extends from the profile of the engine 344, which may also reduce the chance of the female-type ignition wire connector 336 and ignition wire 340 from being interfered with (e.g., accidental contact that could cause damage to the spark plug or the ignition wire 340) and reduce space requirements. To allow for such an arrangement, the plug end 304 must be sized such that the female-type ignition wire connector 336 fits within the space between the male-type ignition wire connector 332 and the engine 344 without contacting the engine 344.

In some embodiments, the spark plug boot 300 is installed by pressing the plug end 304 of the spark plug boot 300 onto the spark plug until the connector of the spark plug is fully received within the plug end 304 with a snap-fit. However, the female-type ignition wire connector 336 of the ignition wire 340 may need to be coupled to the spark plug boot 300 prior to coupling the plug end 304 to the spark plug. For example, the female-type ignition wire connector 336 may not be able to be coupled to the wire end 312 after the plug end 304 is coupled to the spark plug, because there may not be enough room between the wire end 312 and the engine 344 to accommodate such an assembly.

Figure 9:
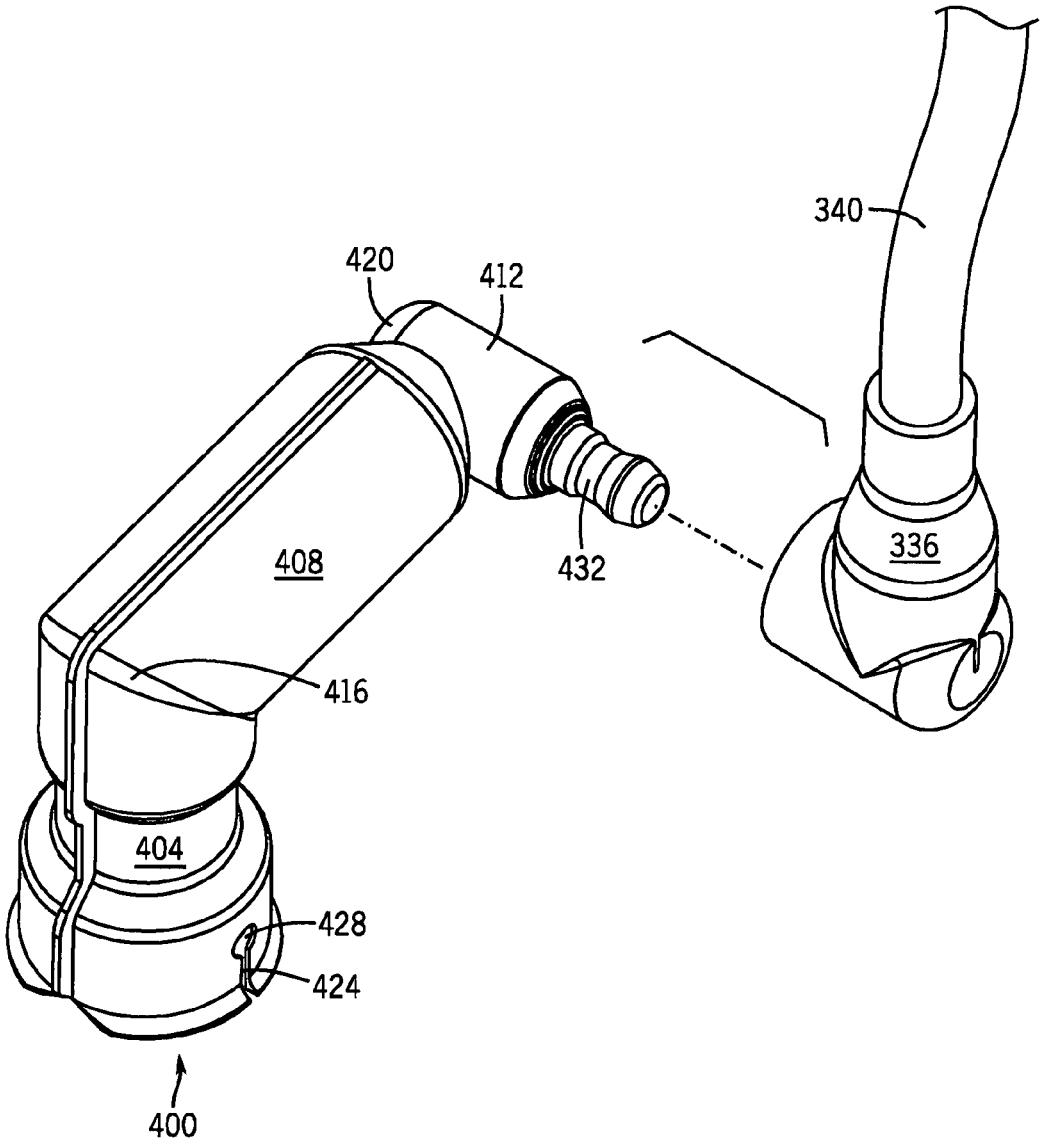
FIG. 9 is a perspective view of another embodiment of a spark plug boot having two elbows.

FIG. 9 is a perspective view of another exemplary embodiment of a spark plug boot 400 having a spark plug receiving end ("plug end") 404, a resistive element portion 408, and an ignition wire connecting end ("wire end") 412. A first elbow 416 is positioned between the plug end 404 and the resistive element portion 408, while a second elbow 420 is positioned between the resistive element portion 408 and the wire end 412. Similar to the embodiment shown in FIGS. 6-8, the first and second elbows 416 and 420 both form an approximate 90 degree angles. However, in the embodiment shown in FIG. 9, the second elbow 420 is turned such that the plug end 404 and the wire end 412 are no longer in the same plane. For example, the wire end 412 is positioned 90 degrees or transverse to the plug end 404 and resistive element portion 408. In other embodiments, the wire end 412 may be positioned at a different angle with respect to the plug end 404 and the resistive element portion 408.

Figure 10:
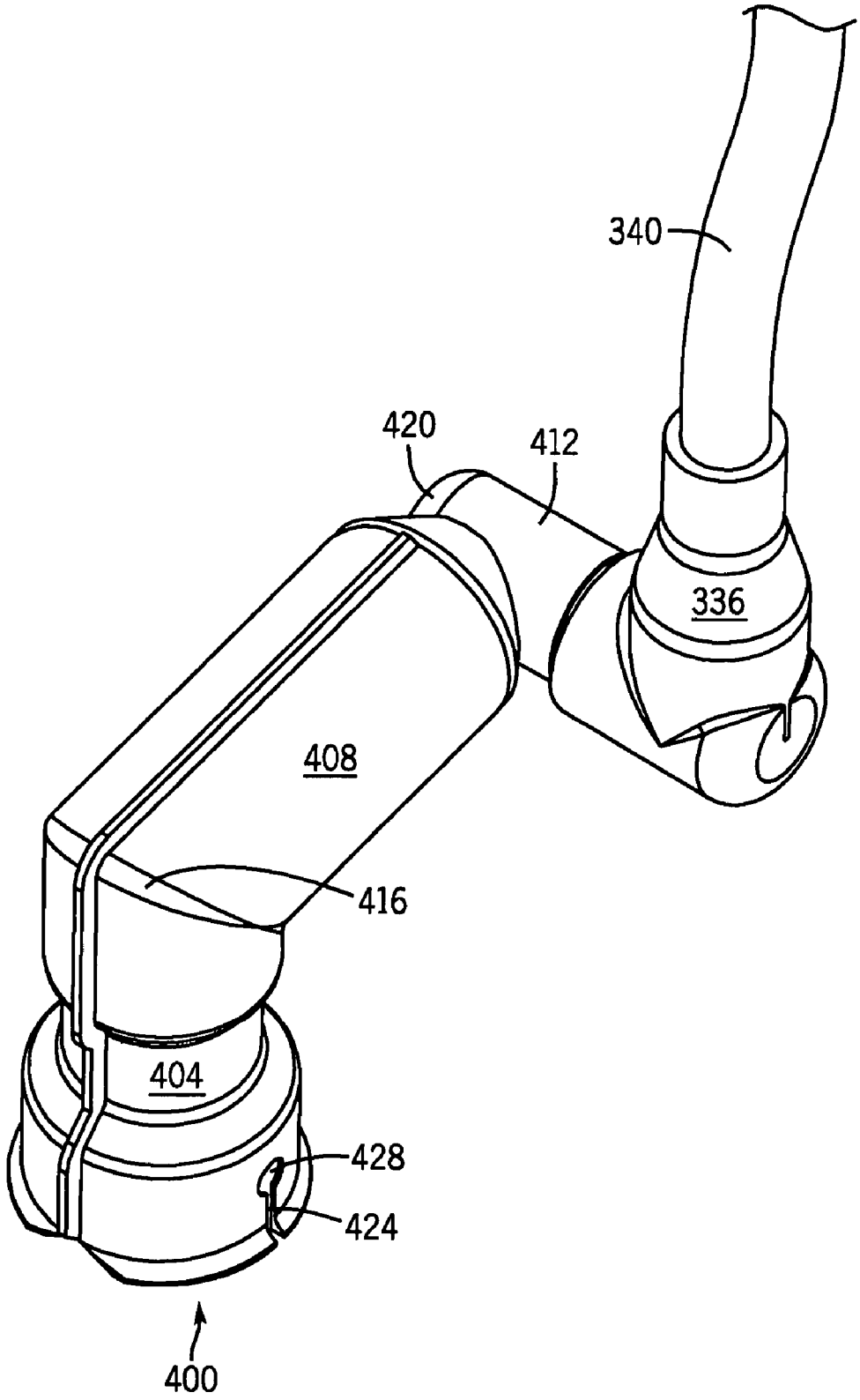
FIG. 10 is another perspective view of the spark plug boot shown in FIG. 9.

As shown in FIG. 10, changing the orientation of the wire end 412 with respect to the plug end 404 affects the routing of the female-type ignition wire connector 336 and the ignition wire 340. For example, rather than the female-type ignition wire connector 336 being positioned in the same plane as the plug end (see FIGS. 6-8), the female-type ignition wire connector 336 is positioned relatively transverse to, and in a different plane than the plug end 404 and the resistive element portion 408. In fact, plus end 404, wire end 412 and resistive element portion 408 are all transverse to each other, and no two of them lie in the same plane. Such a configuration reduces the need for the plug end 404 to be long enough to provide clearance for the female-type ignition wire connector 336. Additionally, as described in greater detail below, this configuration may also provide more space between the engine 344 and the female-type ignition wire connector 336 of the ignition wire 340.

FIG. 11 illustrates the spark plug boot 400 shown in FIGS. 9 and 10 coupled to the engine 344. Due to the orientation of the wire end 412, the coupled female-type ignition wire connector 336 is positioned non-coplanar to the spark plug boot 400. Unlike the embodiment shown in FIGS. 6-8, this configuration does not require the female-type ignition wire connector 336 or the ignition wire 340 to be routed back toward the engine 344. As such, the configuration of the spark plug boot 400 shown in FIGS. 9-11, may reduce interference between the ignition wire 340 and the engine 344, while also providing an ignition wire arrangement that follows the contour of the engine 344 (e.g., the female-type ignition wire connector 336 and the ignition wire 340 do not substantially extend away from the engine 344). Additionally, the spark plug boot 400 components do not need to be coupled to the spark plug and the ignition wire 340 in any particular order. For example, the plug end 404 can be pressed onto the spark plug before, as well as after, coupling the ignition wire 340 to the wire end 412.

The embodiments described with respect to FIGS. 6-11 generally include a substantially rigid wire end, plug end, and ignition wire connectors that couple to each other with a snap-fit. The rigid, snap-fit components may help an assembler more quickly couple the ignition wire to the wire end and the spark plug to the plug end. For example, connections can be made with the spark plug and the female-type ignition wire connector without any of the components substantially flexing. Additionally, no tools are required to couple the spark plug boot to the spark plug or the ignition wire, and the ignition wire need not be screwed onto a screw-type connector. The speed with which an assembler can couple these components together can also result in an overall labor cost savings.

The embodiments of the spark plug boots described herein can be retrofitted to existing engines (and spark plugs). For example, a spark plug boot can be added to an engine by removing the ignition wire from the spark plug and introducing the spark plug boot between the two. The spark plug boots may also be fitted to new engines and spark plugs.

The invention claimed is:

1. A spark plug connector that electrically connects an engine ignition wire to a spark plug, comprising:

a wire end, including a wire connector configured to be electrically connected to an ignition wire;

a resistive element having a resistive element therein;

a wireless electrical connector that is electrically connected between the wire connector and the resistive element;

a plug end, including a spark plug coupler configured to be coupled to a spark plug;

a wireless intermediate terminal configured to electrically connect the resistive element to the spark plug coupler, wherein the wireless intermediate terminal is disposed at a 90 degree angle to the resistive element;

a first insulating layer disposed around the resistive element and the wire connector;

a second insulating layer disposed around the first insulating layer and around the spark plug coupler; and a metal casing disposed over at least a portion of the second insulating layer.

2. The spark plug connector of claim 1, wherein the resistive element is a wire-wound resistor.

3. The spark plug connector of claim 1, wherein the wire connector includes a male connector member, and a female connector member that snaps onto the male connector member.

4. The spark plug connector of claim 1, wherein the first insulating layer is made from a material including polybutylene terephthalate.

5. The spark plug connector of claim 1, wherein the first insulating layer is made a glass-filled thermally insulating material.

6. The spark plug connector of claim 1, wherein the second insulating layer includes silicon.

7. The spark plug connector of claim 1, wherein the wire connector and the spark plug coupler are substantially parallel to each other and lie in the same plane.

8. The spark plug connector of claim 7, wherein the spark plug connector is generally U-shaped.

9. The spark plug connector of claim 1, wherein the wire connector and the spark plug connector are each angled with respect the resistive element.

10. The spark plug connector of claim 1, wherein the wire connector and the spark plug connector do not lie in the same plane.

11. The spark plug connector of claim 1, wherein the wire end is transverse to the plug end, and wherein the wire end and the plug end do not lie in the same plane.

12. The spark plug connector of claim 1, wherein the wire end, the plug end, and the resistive element are all transverse to each other.

13. The spark plug connector of claim 1, wherein the metal casing includes a receptacle housing at one end.

* * * * *